US005480510A

United States Patent [19]

Manusch et al.

[11] Patent Number: 5,480,510

[45] Date of Patent: Jan. 2, 1996

[54] CARTRIDGE FOR HAND-OPERATED FILM APPLICATOR

[75] Inventors: Christoph Manusch, Hemmingen; Udo Obersteller, Langenhagen; Wulf Herrmannsen, Ronnenberg, all of Germany

[73] Assignee: Pritt Produktionsgesellschaft mbH, Hannover, Germany

[21] Appl. No.: 270,640

[22] Filed: Jul. 1, 1994

[30] Foreign Application Priority Data

Jul. 2, 1993 [DE] Germany ..... 43 22 120.3

[51] Int. Cl.[6] ..... B32B 31/00

[52] U.S. Cl. ..... 156/577; 156/523; 156/540; 156/579

[58] Field of Search ..... 156/523, 540, 156/527, 574, 579, 584

[56] References Cited

U.S. PATENT DOCUMENTS

| | | | |
|---|---|---|---|
| 4,060,444 | 11/1977 | Schweig, Jr. et al. | 156/391 |
| 4,849,064 | 7/1989 | Manusch et al. | 156/577 |
| 5,049,229 | 9/1991 | Czech | 156/577 |
| 5,310,437 | 5/1994 | Tucker | 156/238 |
| 5,346,580 | 9/1994 | Elges et al. | 156/540 |

FOREIGN PATENT DOCUMENTS

0377085A3 11/1990 European Pat. Off. .

*Primary Examiner*—James Engel

*Attorney, Agent, or Firm*—Herbert Dubno; Andrew Wilford

[57] ABSTRACT

A cartridge for a film applicator has a body having parallel and spaced upper and lower end walls formed with respective upper and lower coaxial holes, a supply spool having a core ring and sandwiched between the end walls coaxial with the holes, a takeup spool, and holding formations on the body releasably securing the takeup spool underneath the lower end wall coaxial with the holes and supply spool so that the spools axially flank the lower end wall. A guide extends parallel to the hole axis through the lower wall and the guide, supply spool, and body are made of substantially the same material. A supply of tape has an outer end fixed to the takeup spool and an inner end and forms a loop having an upper leg engaging the guide between the end walls and a lower leg engaging the guide below the lower end wall The inner end of the tape is releasably secured to the supply spool so it can be separated therefrom with very little force, and a pair of spaced arms unitarily formed with the body hold the loop.

17 Claims, 5 Drawing Sheets

CARTRIDGE FOR HAND-OPERATED FILM APPLICATOR

FIELD OF THE INVENTION

The present invention relates to a hand-operated film applicator. More particularly this invention concerns a cartridge for such an applicator.

BACKGROUND OF THE INVENTION

A standard hand-operated device for transferring a film from a carrier tape to a substrate as described in commonly owned U.S. Pat. Nos. 4,849,064 and 4,853,074 has a housing made of two parts that are pivoted together. The housing has two rotatable spindles coupled to each other by a slip-permitting transmission. A cartridge is held in this housing and has fitting on the pivot pins a supply spool and a takeup spool for the tape and an applicator element at one end. The tape passes from the supply spool over the applicator element which is used to press the tape against the substrate for transfer of the film from the tape to the substrate. After the film is stripped from the tape, this tape is wound up on the takeup spool which itself is provided with a one-way brake allowing it to rotate only in one direction.

In such a system the cartridge contains the supply spool, the takeup spool, and the applicator foot so that putting a new supply of tape into the applicator is a fairly simple job. The cartridge, however, is a fairly complex item that is very difficult to recycle. First of all the plastic of the cartridge body itself is invariably different from that of the support tape and normally also from the spools, and the applicator foot is frequently a separate part of yet another resin. Thus to recycle the device it is necessary to break it apart and sort the various parts according to the resin they are made of. The tape is left wound on the takeup spool and the spool and tape are of different resins, but separating the tape from the spool is such an onerous operation that this part is typically discarded without recycling. All in all, breaking apart and sorting the parts of such a cartridge is more work than the modest recycle value of its parts warrants.

Another disadvantage with the known cassette is that it is quite bulky and expensive. It must be large enough to contain, to start with, the full supply spool and empty takeup spool, and it includes the critical applicator foot since the tape must be exactly guide over and maintained taut around this foot so that loading a cartridge without such a foot is almost impossible.

OBJECTS OF THE INVENTION

It is therefore an object of the present invention to provide an improved cartridge for a tape or film applicator.

Another object is the provision of such an improved cartridge for a tape or film applicator which overcomes the above-given disadvantages, that is which is easy to recycle, is relatively compact, and which can be produced at very low cost.

SUMMARY OF THE INVENTION

A cartridge for a film applicator has according to the invention a body having parallel and spaced upper and lower end walls formed with respective upper and lower coaxial holes, a supply spool having a core ring and sandwiched between the end walls coaxial with the holes, a takeup spool, and holding formations on the body releasably securing the takeup spool underneath the lower end wall coaxial with the holes and supply spool so that the spools axially flank the lower end wall. A guide extends parallel to the hole axis through the lower wall and the guide, supply spool, and body are made of substantially the same material. A supply of tape has an outer end fixed to the takeup spool and an inner end and forms a loop having an upper leg engaging the guide between the end walls and a lower leg engaging the guide below the lower end wall The inner end of the tape is releasably secured to the supply spool so it can be separated therefrom with very little force, and a pair of spaced arms unitarily formed with the body hold the loop.

Since the takeup spool is outside the cartridge and the tape is loosely secured to the feed or supply spool, when the cartridge is exhausted the tape and takeup spool, which according to the invention can be made of the same material, are left separate from the cartridge body. Furthermore mounting the takeup spool outside the body of the cartridge allows this element to be made much smaller and, therefore, more cheaply. Furthermore, this cartridge is used together with an applicator such as described in commonly owned U.S. patent application (attorney's docket 19330) that itself has a displaceable applicator foot so that after the cartridge is mounted in the housing, with the loop engaged loosely around the foot, the foot is moved out to tighten the tape. Since the application force is applied to this foot, which is part of the housing and not of the tape cartridge, the tape cartridge itself can be made of relatively flimsy material.

The body can be one or more molded pieces of synthetic resin. Preferably it is made of a folded sheet of the material, which can be cardboard. The walls are both generally circularly annular and have radial extensions forming the arms. The radial extensions are each formed with a pair of strips and each arm is formed by two of the strips, normally glued or crimped together to make them relatively stiff. In addition the radial extension of the lower end wall has a web extending parallel to and spaced below the lower end wall and having an edge turned toward the axis and shaped so that its point of closest approach to the axis it is spaced from the axis by a spacing greater than a maximum radius of the takeup spool when substantially all the tape is wound up on it. The guide is a roller traversing the lower end wall and having ends engaging the upper end wall and web.

Making the cartridge body, supply spool, and guide roller of cardboard makes the bulk of the cartridge easily recyclable. Even if not recycled, cardboard is environmentally inoffensive and in fact can be biodegradable. Stamping and folding a blank of cardboard is a relatively simple task requiring no application of heat so that once again production costs are held down.

The roller according to the invention is cylindrically tubular and the web is formed with a hole axially aligned with the roller so that a support pin can pass through the web hole into the tubular roller. In addition the web and lower end wall are formed with axially aligned centering holes so that a centering pin can pass through the centering holes. One of the end walls is formed with a plurality of projections extending toward the other wall, angularly equispaced about the axis, radially equispaced from the axis, and guidingly surrounding the supply spool. Furthermore the body includes a web interconnecting the end walls and extending generally perpendicular thereto and a pair of arcuate stiffening strips extending from the web and braced axially on edge between the end walls.

The lower end wall, which in fact could be above the upper end wall, is formed unitarily with a plurality of angularly spaced angled tabs constituting the holding formations and radially outwardly engaging the takeup spool. Each tab has an outer end formed with a radially outwardly projecting finger that engages behind the takeup spool. The upper end wall is formed with a notch open radially inward into the respective hole so that a user can see through the notch how much of the tape is left on the supply spool. The takeup spool has a larger outside diameter than the supply spool.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
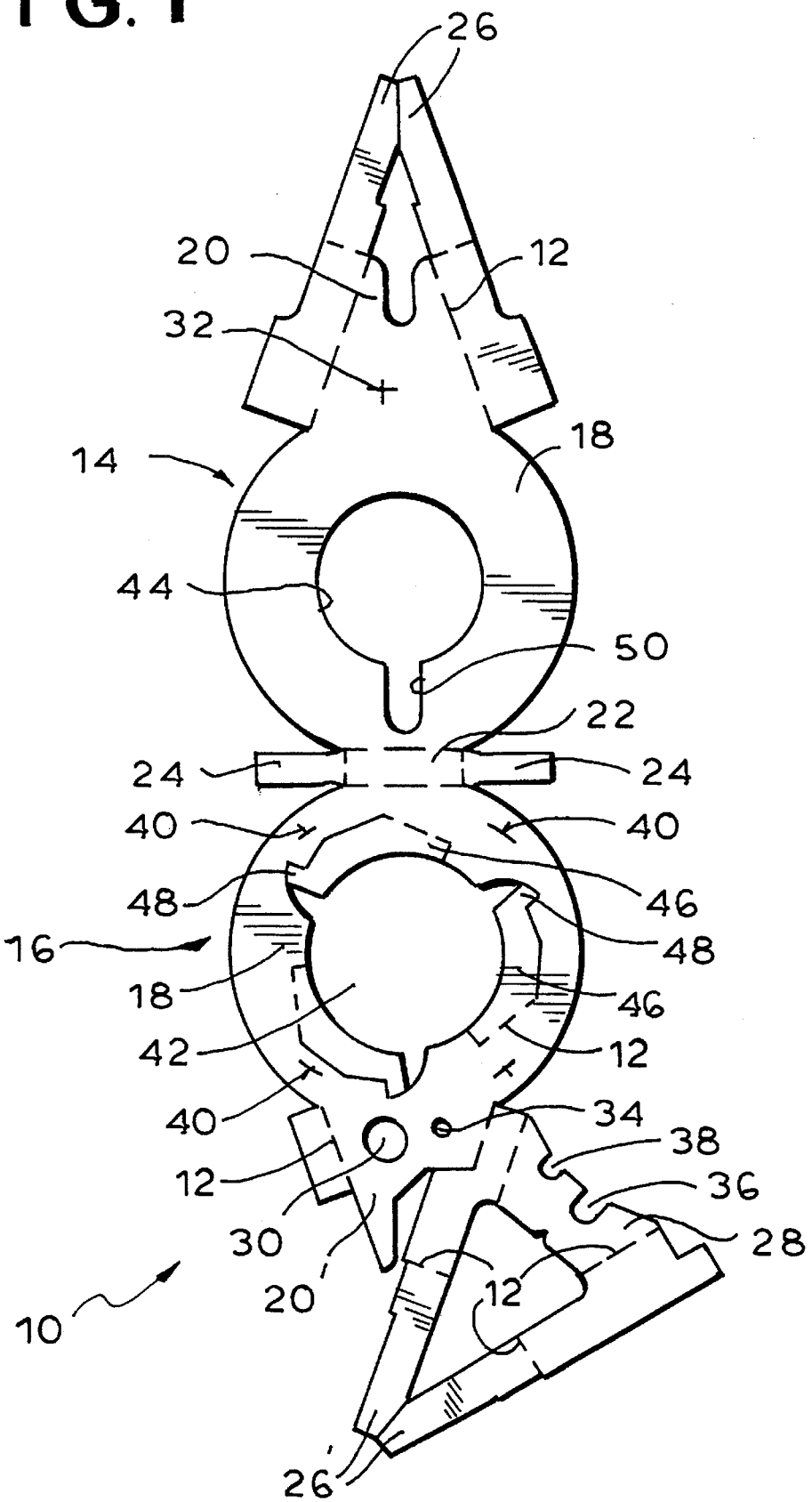
FIG. 1 is a plan view of a cardboard blank for the body of a cartridge according to the invention.
Figure 2:
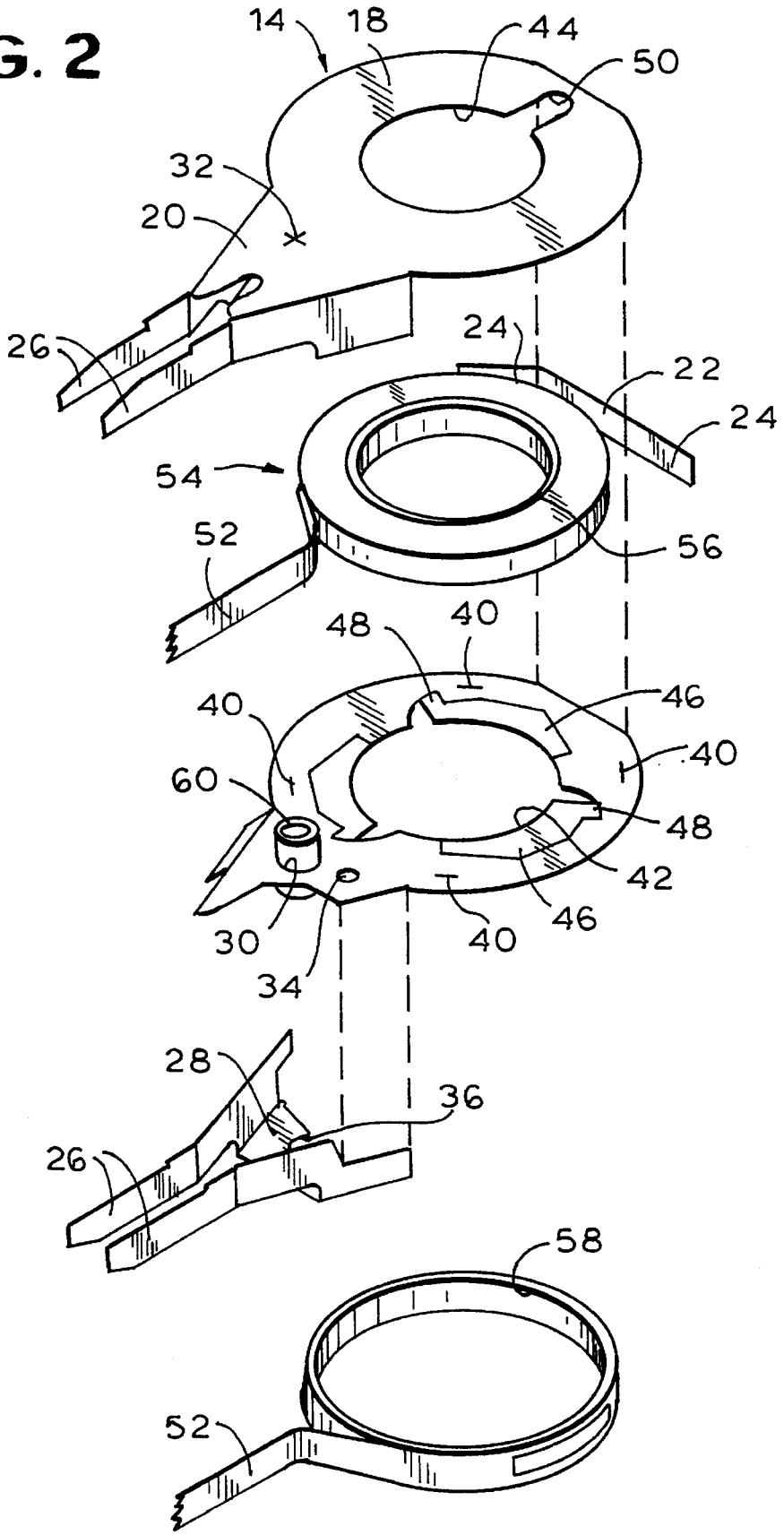
FIG. 2 is an exploded view of the cardboard cartridge of this invention.
Figure 3:
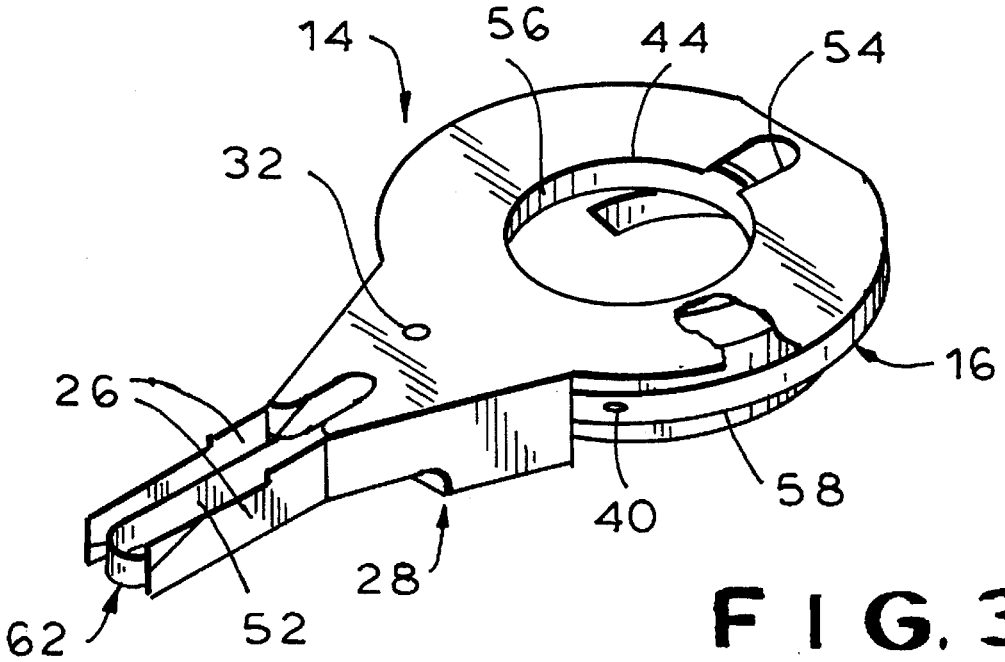
FIG. 3 is a perspective view of the cardboard cartridge.

As seen in FIG. 1 a cartridge according to this invention is made from a stiff cardboard blank 10 cut to the illustrated shape and formed with fold lines 12. The blank 10 has a pair of annularly circular portions 18 that are of the same outside diameter and that are interconnected by a short rectangular web 22 from whose ends stiffening strips 24 project tangentially of the portions 18. These portions 18 form upper and lower end walls 14 and 16 that extend parallel to each other when in use as seen in FIGS. 2 and 3. The upper end wall 14 is formed on its side opposite the web 22 with a trapezoidal extension 20 along whose sides extend a pair of upper guide strips 26 that converge. A punched-in portion 32 in this extension 20 acts as the axis for a deflecting roller 60 shown in FIG. 2.

The lower end wall 16 has on its side opposite the web 22 an extension 20' which is formed with a circular aperture 30 that is aligned in the finished cartridge with the pivot-forming portion 32 and through which a guide roller 60 (FIG. 2) extends with some play. Another hole 34 formed in this extension 20' accommodates a centering pin 76 (FIG. 8 only) that is fixed in a main housing part 68 of the applicator that receives the finished cartridge. Extending from one edge of the extension 20' is another web 28 and two more converging guide strips 26'. In the finished cartridge the web 28 lies parallel to but below the lower end wall 16 and the edge of the web 28 has a radius of curvature corresponding to that of a full takeup spool as described below. A large notch 36 cut in the edge of the web 28 aligns with the hole 30 and pushed-in portion 32 so that a pivot pin 74 (FIG. 8) in the applicator can extend into the roller 60 and stabilize it, while the above-mentioned centering pin 76 can extend through a smaller notch 38 cut in the edge of the web 28. Punched-in portions 40 in the lower wall 18 serve to center the full supply spool 54 (FIG. 2) and the portions 40 closest to the web 22 also hold in the stiffening strips 24 since they are formed like sawteeth with radially outer shallow flanks and radially inwardly directed perpendicular flanks. Thus in the complete cartridge each of these strips 24 is bent to extend arcuately perpendicular to the end walls 14 and 16, thereby greatly stiffening the complete cartridge and preventing the end walls 14 and 16 from pinching a supply spool 54 sandwiched between them.

Figure 8:
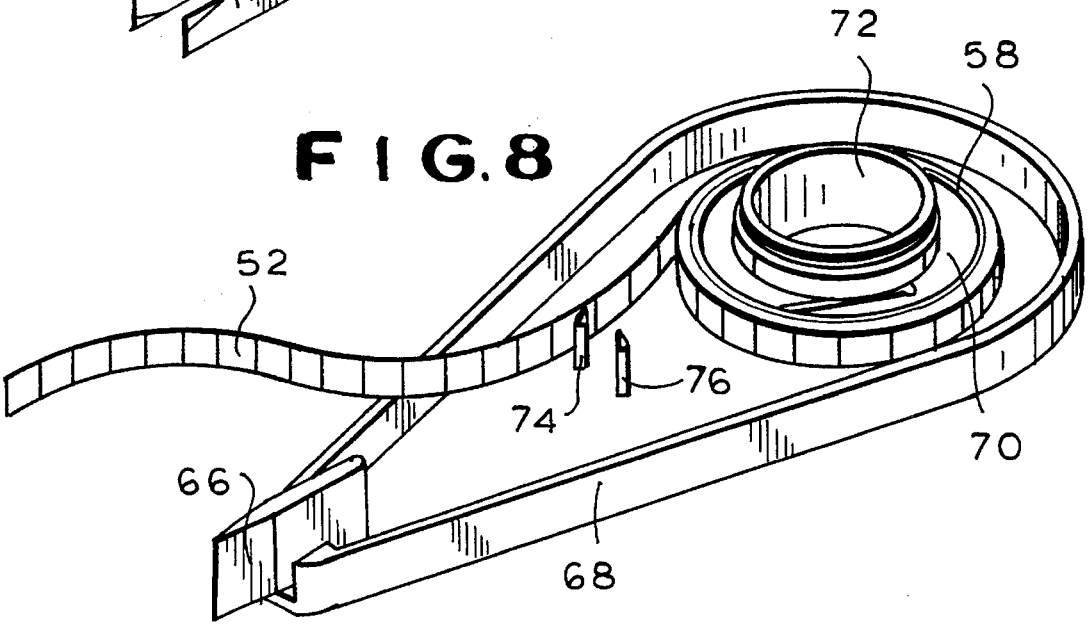
FIG. 8 is a perspective view of the applicator after the used-up cartridge has been removed.

The upper wall 14 is formed with a central small-diameter circular hole 44 of a radius slightly greater than that of the upper portion of a hub 72 (FIG. 6) which is fixed in the applicator housing 68 and which in turn is somewhat smaller than the inside diameter of a supply-spool core 56 (FIG. 8). A radial notch 50 opening inward into the hole 44 allows the user to see how much tape 52 is left on the supply-spool core 56. The lower wall 16 has a somewhat larger central hole 42 which is in part formed by the inner edges of three downwardly deflected tabs 46 each having an outer end with a radially outwardly projecting extension or finger 48 and each deflectable downwardly by means of a fold line 12 extending tangentially of the opening 42. These tabs 46 are dimensioned to engage into and grip an empty takeup core or spool 58. The inner diameter of the spool 58 is greater by at least twice the radial dimension of these tabs 46 than the free diameter of the hole 42.

In the finished cartridge the blank 10 is folded at the fold lines 12 around the web 22 so that the two walls 14 and 16 are parallel to each other and perpendicular to the web 22 which remains planar. The supply spool 54 is inserted between the two walls 14 and 16 with the outer end of its tape 52 attached to an empty takeup spool 58. A roller 60 is inserted through the hole 30 with the tape 52 passing to one side of it and the tape 52 is routed back past the other side of the roller 60 and the spool 58 is secured to the bottom face of the bottom wall 16 by the tabs 46 that are pushed down into it. The web 28 and strips 26' are bent down and then the web 28 and outer strip 26' is bent up and the strips 26 are bent down to bring each of the strips 26 to lie flatly against a respective one of the strips 26', and these double-thick strips 26, 26' may even be glued together. A loop 62 of the tape 52 is left held between the arms formed by the strips 26 and 26' as best seen in FIG. 3. Thus the loop 62 has an upper leg running back between the walls 14 and 16 to the supply spool 54 and a lower leg running down at a slight angle and passing between the lower wall 16 and the web 28. This assembly is stable and can be handled without coming apart.

Figure 4:
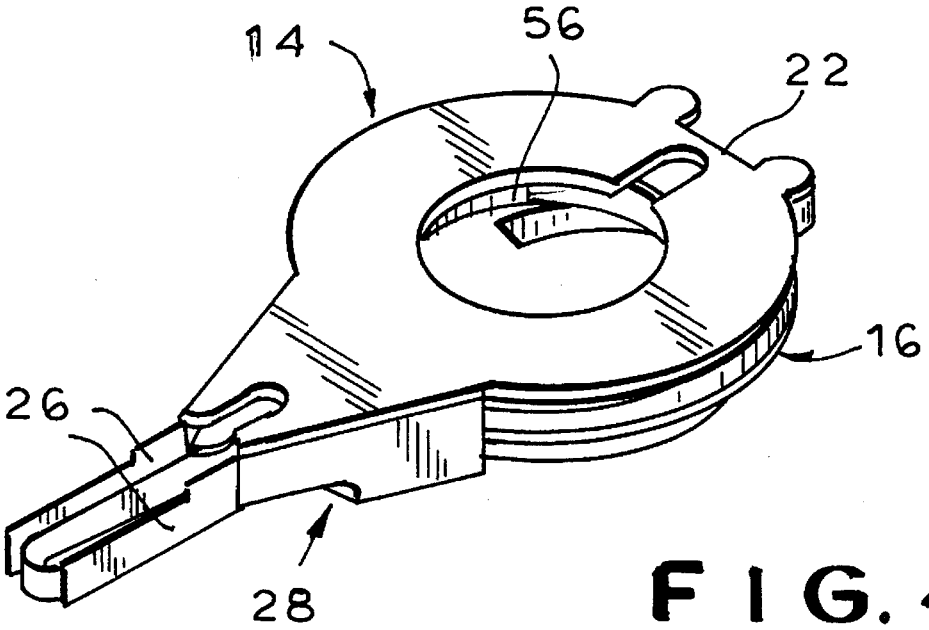
FIG. 4 is a view like FIG. 3 of a cartridge molded of plastic.

FIG. 4 shows a similar structure that is molded from plastic. The structure is substantially identical to that of FIG. 3 and in fact the device can be produced flat with fold lines molded right into it. An actual pivot instead of the pushed-in part 32 and little sawteeth instead of the pushed-in portions 40 can be molded right into such a cartridge.

Figure 5A:
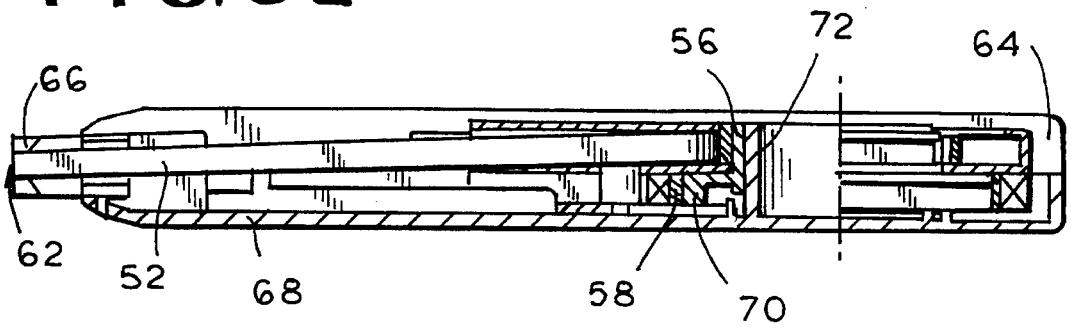
FIG. 5*a* is a longitudinal section through a film applicator equipped with the cartridge of this invention.
Figure 5B:
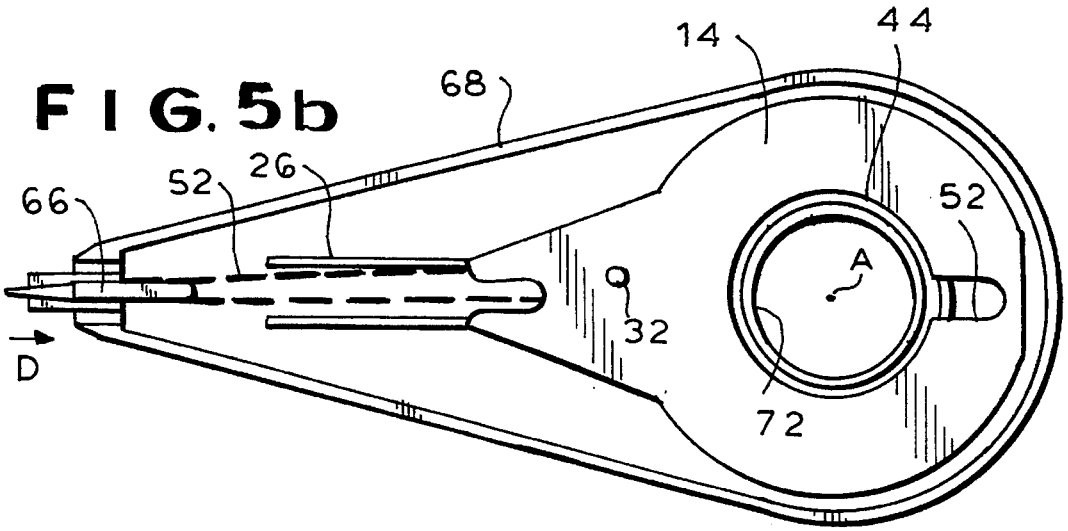
FIG. 5*b* is a top view of the applicator of FIG. 5*a* with its cover removed.
Figure 5C:
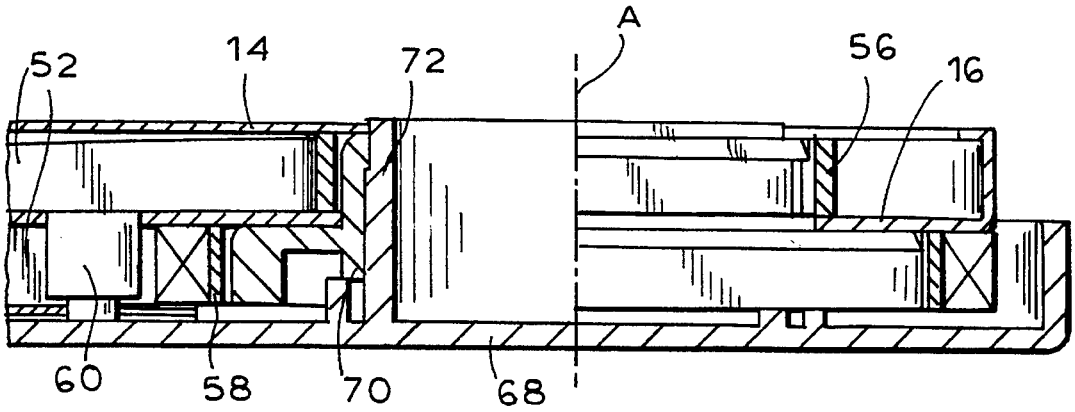
FIG. 5*c* is a large-scale view of a detail of FIG. 5*a;*

To insert the thus formed cartridge in an applicator as shown in FIGS. 5*a* through 5*c* one removes a cover part 64 of this applicator, leaving its base part 68 open. A guide foot 66 on this base part 68 is pushed longitudinally inward as indicated by arrow D of FIG. 5*b*. Then the cartridge is set in place over the hub 72 which is centered on an axis A and carries a stepped hub sleeve 70 that can rotate about this axis A and that has a small-diameter upper portion dimensioned to fit snugly in the supply-spool core 56 and a larger-diameter lower part that fits somewhat more loosely in the takeup spool 58. As the hub sleeve 70 fits into the spools 56 and 58 a shoulder between its portions pushes the tabs 46 back up to a position coplanar with the wall 16 so that they release the takeup spool 58.

The loop 62 is meanwhile looped over the foot 66 which then is moved out against the direction D to take up any slack in the tape 52 and, if necessary, even pull some more tape 52 off the spool 54. The cover 74 is reinstalled and the device is ready to use.

As the foot 6 is moved in transverse direction T over a substrate, the film on the tape 52 sticks to and is transferred to this substrate, the tape 52 is pulled off the spool 54 and the film-free tape 52 is wound up on the spool 58. Since the spool 58 is always of greater diameter than the spool 54, the rotation transmitted by the sleeve 70 from the spool 54 to the spool 58 will keep the tape 52 taut since the spool 58 will always try to move at a faster peripheral speed and will slip a little on the sleeve 70.

Figure 6:
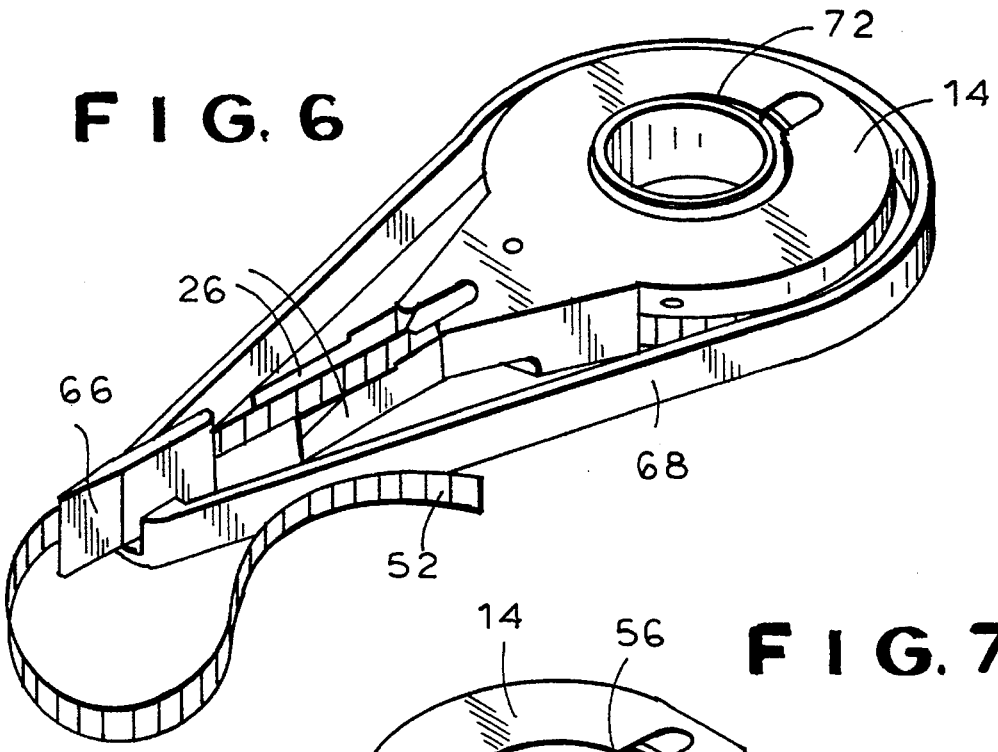
FIG. 6 is a perspective view of the open applicator when the film has been used up.
Figure 7:
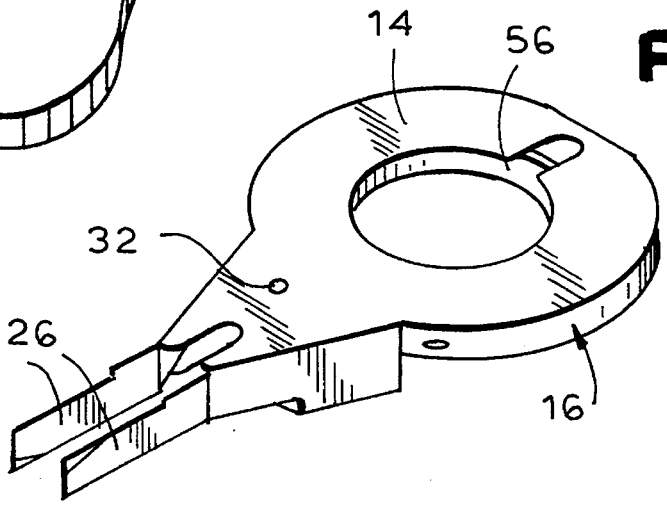
FIG. 7 is a perspective view of the used-up cartridge.

The inner end of the tape 52 is attached very weakly to the spool core 56. Thus when the last bit of the film 52 is used up this tape 52 will actually become disattached from the spool core 56 and will hang from the applicator as shown in FIG. 6. The user then opens the applicator and lifts out the cartridge, but only the body and core 58, which are advantageously formed of the same material, will come out as shown in FIG. 7 since the tabs 46 have been pushed out of contact with the takeup spool 58. The spool 58 and the film-free tape 52, which are also formed according to this invention of the same resin, will be left as shown in FIG. 8 to be stripped out separately.

Thus the cartridge according to this invention can be recycled with ease. The blank 10, roller 60, and spool core 56 are all made of the same material, such as cardboard or a synthetic-resin polymer, so they can be routed to the appropriate recycling or waste bin. The tape 52 and spool 58, which are normally of some other synthetic resin, are also of the same material so they are routed to the appropriate waste or recycling bin. There is no need for the user to take apart the spent carriage to recycle it.

We claim:

1. A cartridge for a film applicator, the cartridge comprising:

a body having parallel and spaced upper and lower end walls formed with respective upper and lower coaxial holes;

a supply spool having a core ring and sandwiched between the end walls coaxial with the holes;

a takeup spool;

means including holding formations on the body releasably securing the takeup spool underneath the lower end wall coaxial with the holes and supply spool, whereby the spools axially flank the lower end wall;

a guide extending parallel to the hole axis through the lower wall, the guide, supply spool, and body being made of substantially the same material;

a supply of tape having an outer end fixed to the takeup spool and an inner end and forming a loop having an upper leg engaging the guide between the end walls and a lower leg engaging the guide below the lower end wall;

means releasably securing the inner end of the tape to the supply spool; and a pair of spaced arms unitarily formed with the body and holding the loop.

2. The film-applicator cartridge defined in claim 1 wherein the body is made of a folded sheet of the material.

3. The film-applicator cartridge defined in claim 2 wherein the material is cardboard.

4. The film-applicator cartridge defined in claim 1 wherein the body is molded of plastic.

5. The film-applicator cartridge defined in claim 1 wherein the walls are both generally circularly annular and have radial extensions forming the arms.

6. The film-applicator cartridge defined in claim 5 wherein the radial extensions are each formed with a pair of strips and each arm is formed by two of the strips.

7. The film-applicator cartridge defined in claim 5 wherein the radial extension of the lower end wall has a web extending parallel to and spaced below the lower end wall and having an edge turned toward the axis and shaped so that at its point of closest approach to the axis it is spaced from the axis by a spacing greater than a maximum radius of the takeup spool when substantially all the tape is wound up on it.

8. The film-applicator cartridge defined in claim 7 wherein the guide is a roller traversing the lower end wall and having ends engaging the upper end wall and web.

9. The film-applicator cartridge defined in claim 8 wherein the roller is cylindrically tubular and the web is formed with a hole axially aligned with the roller, whereby a support pin can pass through the web hole into the tubular roller.

10. The film-applicator cartridge defined in claim 7 wherein the web and lower end wall are formed with axially aligned centering holes, whereby a centering pin can pass through the centering holes.

11. The film-applicator cartridge defined in claim 7 wherein one of the end walls is formed with a plurality of projections extending toward the other wall, angularly equispaced about the axis, radially equispaced from the axis, and guidingly surrounding the supply spool.

12. The film-applicator cartridge defined in claim 7 wherein the body includes a web interconnecting the end walls and extending generally perpendicular thereto and a pair of arcuate stiffening strips extending from the web and braced axially on edge between the end walls.

13. The film-applicator cartridge defined in claim 1 wherein the lower end wall is formed unitarily with a plurality of angularly spaced angled tabs constituting the holding formations and radially outwardly engaging the takeup spool.

14. The film-applicator cartridge defined in claim 13 wherein each tab has an outer end formed with a radially outwardly projecting finger that engages behind the takeup spool.

15. The film-applicator cartridge defined in claim 1 wherein the upper end wall is formed with a notch open radially inward into the respective hole, whereby a user can see through the notch how much of the tape is left on the supply spool.

16. The film-applicator cartridge defined in claim 1 wherein the takeup spool has a larger outside diameter than the supply spool.

17. An applicator for a film carried on a tape, the applicator comprising:

a housing having a main part and a cover part that normally fit complementarily together;

a cartridge body in the housing having parallel and spaced upper and lower end walls formed with respective upper and lower coaxial holes;

a supply spool having a core ring and sandwiched between the end walls coaxial with the holes;

a takeup spool;

means including holding formations on the body releasably securing the takeup spool underneath the lower end wall coaxial with the holes and supply spool, whereby the spools axially flank the lower end wall;

a guide extending parallel to the hole axis through the lower wall, the guide, supply spool, and body being made of substantially the same material;

a supply of the tape having an outer end fixed to the takeup spool and an inner end and forming a loop having an upper leg engaging the guide between the end walls and a lower leg engaging the guide below the lower end wall;

means releasably securing the inner end of the tape to the supply spool;

a pair of spaced arms unitarily formed with the body and holding the loop.

a slide displaceable longitudinally in the housing between a retracted inner end position relatively close to the spools and an extended outer end position relatively far from the spools and projecting from the housing; and an applicator foot fixed on and displaceable with the slide, the tape being spanned over the foot, the loop being engaged over the foot.

* * * * *